US009065213B2

(12) United States Patent
Jeon

(10) Patent No.: US 9,065,213 B2
(45) Date of Patent: Jun. 23, 2015

(54) ELECTRICAL CONNECTOR FOR TRANSMITTING DATA SIGNALS

(71) Applicant: Tyco Electronics Corporation, Berwyn, PA (US)

(72) Inventor: Myoungsoo Jeon, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 112 days.

(21) Appl. No.: 13/934,660

(22) Filed: Jul. 3, 2013

(65) Prior Publication Data

US 2015/0011125 A1 Jan. 8, 2015

(51) Int. Cl.
*H01R 12/00* (2006.01)
*H01R 13/646* (2011.01)

(52) U.S. Cl.
CPC ..... *H01R 13/646* (2013.01)

(58) Field of Classification Search
CPC ..... H01R 23/7073; H01R 13/6616; H01R 13/514; H01R 23/688
USPC ..... 439/607.07, 607.11, 620.16, 620.21, 439/79, 701
See application file for complete search history.

(56) References Cited

U.S. PATENT DOCUMENTS

| | | | | |
|---|---|---|---|---|
| 4,748,068 | A * | 5/1988 | Fahner et al. | 428/201 |
| 5,924,899 | A | 7/1999 | Paagman | |
| 6,932,649 | B1 | 8/2005 | Rothermel et al. | |
| 6,979,226 | B2 | 12/2005 | Otsu et al. | |
| 7,285,018 | B2 | 10/2007 | Kenny et al. | |
| 7,540,781 | B2 | 6/2009 | Kenny et al. | |
| 7,887,371 | B2 | 2/2011 | Kenny et al. | |
| 8,123,563 | B2 | 2/2012 | Kenny et al. | |

* cited by examiner

*Primary Examiner* — Phuong Dinh

(57) ABSTRACT

Electrical connector including a connector body having a pathway assembly extending between mating and mounting faces of the connector body. The pathway assembly includes a signal conductor having separate conductor segments and a dielectric body that holds the conductor segments of the signal conductor. The conductor segments have respective interior ends that are positioned adjacent to each other with a signal gap therebetween. The pathway assembly also includes a signal-control component that electrically joins the conductor segments and is configured to modify current flowing through the conductor segments. The dielectric body forms an open channel having at least one of the conductor segments disposed therein. The at least one conductor segment has an exposed surface that interfaces with an air gap in the connector body.

20 Claims, 6 Drawing Sheets

ELECTRICAL CONNECTOR FOR TRANSMITTING DATA SIGNALS

BACKGROUND OF THE INVENTION

The subject matter herein relates generally to an electrical connector having signal conductors for transmitting data signals between electrical components engaged to the electrical connector.

Networking and telecommunication systems use electrical connectors to interconnect components of the systems, which may be, for example, a motherboard and a daughter card. The electrical connectors are configured to transmit data signals through multiple signal conductors between the interconnected components. As speed and performance demands of the systems increase, conventional electrical connectors are proving to be insufficient. For example, signal loss and signal degradation are challenging issues for some electrical connectors. There is also a demand to increase the density of signal conductors to increase throughput of the electrical connectors. Moreover, there has been a general trend for smaller electrical devices, including smaller electrical connectors. Increasing the density of signal conductors while also decreasing the size of the electrical connectors, however, renders it more difficult to improve the speed and performance of the electrical connectors.

One known method for improving the performance of an electrical connector includes directly attaching circuit elements to the signal conductors within the electrical connector. For example, signal-control components, such as capacitors, inductors, or resistors, have been directly attached to the signal conductors. These signal-control components may be used to: (a) control a flow of direct current along the signal conductor; (b) filter the signals along the signal conductor; and/or (c) reduce data transmission losses. However, it has become more challenging to include such signal-control components in an electrical connector while also increasing the density of signal conductors and/or decreasing the size of the electrical connector.

In one known electrical connector, the signal conductors are overmolded with a dielectric material. The overmold includes openings or apertures that provide access to the signal conductors. The openings are specifically dimensioned to receive and surround signal-control components that engage the signal conductors. However, in the known connector, it is difficult to visually inspect and confirm that the signal-control components have been properly coupled to the signal conductors. Furthermore, for at least some circumstances, the electrical performance of the known connector is insufficient.

Accordingly, there is a need for an electrical connector that has more reliable connections between the signal conductors and the signal-control components.

BRIEF DESCRIPTION OF THE INVENTION

In one embodiment, an electrical connector is provided that includes a connector body having a mating face and a mounting face that are configured to engage respective electrical components. The electrical connector also includes a pathway assembly that extends between the mating and mounting faces within the connector body. The pathway assembly includes a signal conductor having separate conductor segments and a dielectric body that holds the conductor segments. The conductor segments have respective interior ends that are positioned adjacent to each other with a signal gap therebetween. The pathway assembly also includes a signal-control component that electrically joins the conductor segments and is configured to modify current flowing through the conductor segments. The dielectric body forms an open channel having at least one of the conductor segments disposed therein. The at least one conductor segment has an exposed surface that interfaces with an air gap in the connector body.

In another embodiment, an electrical connector is provided that includes first and second module bodies stacked side-by-side. The first and second module bodies collectively form a mating face and a mounting face. The first and second module bodies define a signal channel therebetween that extends between the mating and mounting faces. The electrical connector also includes a pathway assembly extending through the signal channel between the mating and mounting faces. The pathway assembly includes a signal conductor and a dielectric body that holds the signal conductor such that the signal conductor has an exposed surface. The exposed surface faces one of the first or second module bodies with a predetermined air gap therebetween.

In particular embodiments, the electrical connector is part of a backplane system in which the electrical connector is configured to be mounted to a circuit board (e.g., mother board or daughter card). The backplane system may be capable of transmitting data signals at greater than 20 Gbps.

DETAILED DESCRIPTION OF THE INVENTION

Embodiments described herein include systems (e.g., communication systems) and electrical connectors that are configured to transmit data signals. In particular embodiments, the systems and the electrical connectors are configured for high-speed signal transmission, such as 10 Gbps, 20 Gbps, or more. Embodiments include signal conductors that are at least partially surrounded by one or more dielectric bodies. The dielectric body may hold the signal conductors. For example, a dielectric body may be an overmold that separates the signal conductor from adjacent signal conductors and/or other conductive material. The dielectric body may be shaped or formed to intimately engage one or more surfaces (hereinafter referred to as covered surfaces) but to reveal or allow access to one or more other surfaces (hereinafter referred to as exposed surfaces). The amount of exposure may be predetermined in order to achieve a target electrical performance.

Figure 1:
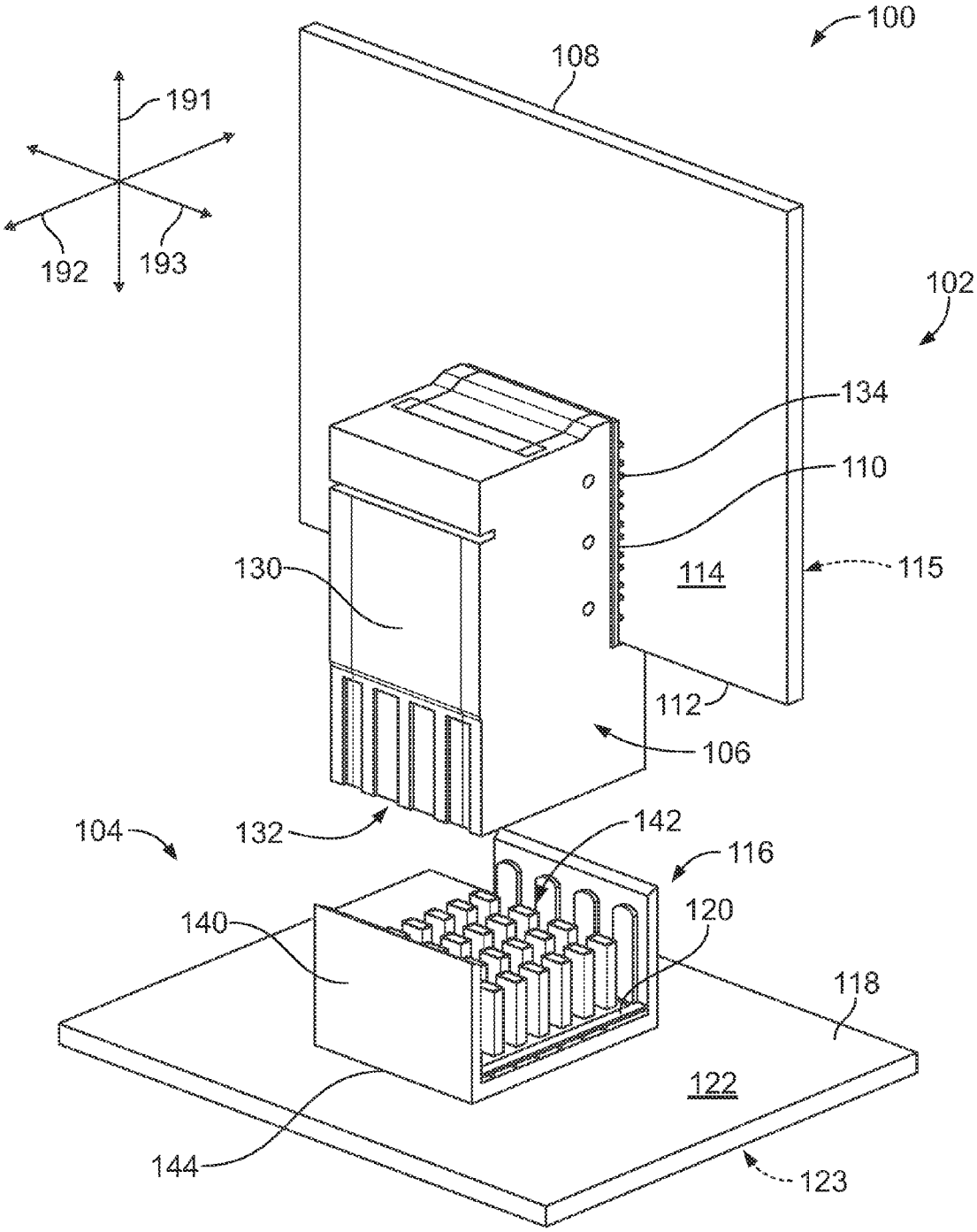
FIG. 1 is a perspective view of a communication system formed in accordance with one embodiment that includes a receptacle connector and a header connector.

FIG. 1 illustrates a communication system 100 that includes a circuit board assembly 102 and a circuit board assembly 104 that are configured to engage each other during a mating operation. The communication system 100 is oriented with respect to mutually perpendicular axes 191-193, including a mating axis 191 and lateral axes 192, 193. As shown, the circuit board assembly 102 includes a first electrical connector 106 (hereinafter referred to as a receptacle connector 106), a circuit board 108, and a grounding matrix 110. The circuit board 108 includes a leading edge 112 and opposite first and second sides 114, 115. The receptacle connector 106 is mounted to the first side 114 along the leading edge 112. The receptacle connector 106 includes a connector body 130 that has a mating face 132 and a mounting face 134. The mating face 132 is configured to engage the circuit board assembly 104, and the mounting face 134 is mounted to the circuit board 108.

The circuit board assembly 104 may also include a second electrical connector 116 (hereinafter referred to as a header connector 116), a circuit board 118, and a grounding matrix 120. The circuit board 118 has opposite first and second sides 122, 123. The circuit board assembly 104 may also include a grounding matrix (not shown) between the header connector 116 and the circuit board 118. The header connector 116 also includes a connector body 140 having a mating face 142 and a mounting face 144. The mounting face 144 is mounted to the circuit board 118. The receptacle and header connectors 106, 116 are configured to engage each other during a mating operation as the receptacle and header connectors 106, 116 are moved relatively toward each other along the mating axis 191. More specifically, the mating faces 132 and 142 may engage each other.

When the receptacle and header connectors 106, 116 are engaged, the grounding matrix 120 may be located along a mating interface (not shown) between the receptacle and header connectors 106, 116. The grounding matrices 110 and 120 are configured to establish multiple contact points between two components along a corresponding interface so that a ground or return path is maintained during operation. The grounding matrices 110, 120 may improve the electrical performance (e.g., improve the communication of data signals) between the corresponding mated components. The grounding matrices 110, 120 are described in greater detail in U.S. application Ser. No. 13/910,670 filed on Jun. 5, 2013, which is incorporated herein by reference in its entirety.

The communication system 100 may be used in various applications. By way of example, the communication system 100 may be used in telecom and computer applications, routers, servers, supercomputers, and uninterruptible power supply (UPS) systems. In such embodiments, the communication system 100 may be described as a backplane system, the circuit board assembly 102 may be described as a daughter card assembly, and the circuit board assembly 104 may be described as a backplane connector assembly. The receptacle and header connectors 106, 116 may be similar to electrical connectors of the STRADA Whisper or Z-PACK TinMan product lines developed by TE Connectivity. In some embodiments, the receptacle and header connectors 106, 116 are capable of transmitting data signals at high speeds, such as 10 Gbps, 20 Gbps, or more. Although the communication system 100 is illustrated as a backplane system, embodiments are not limited to such systems and may be used in other types of systems. As such, the receptacle and header connectors 106, 116 may be referred to generally as electrical connectors.

Figure 2:
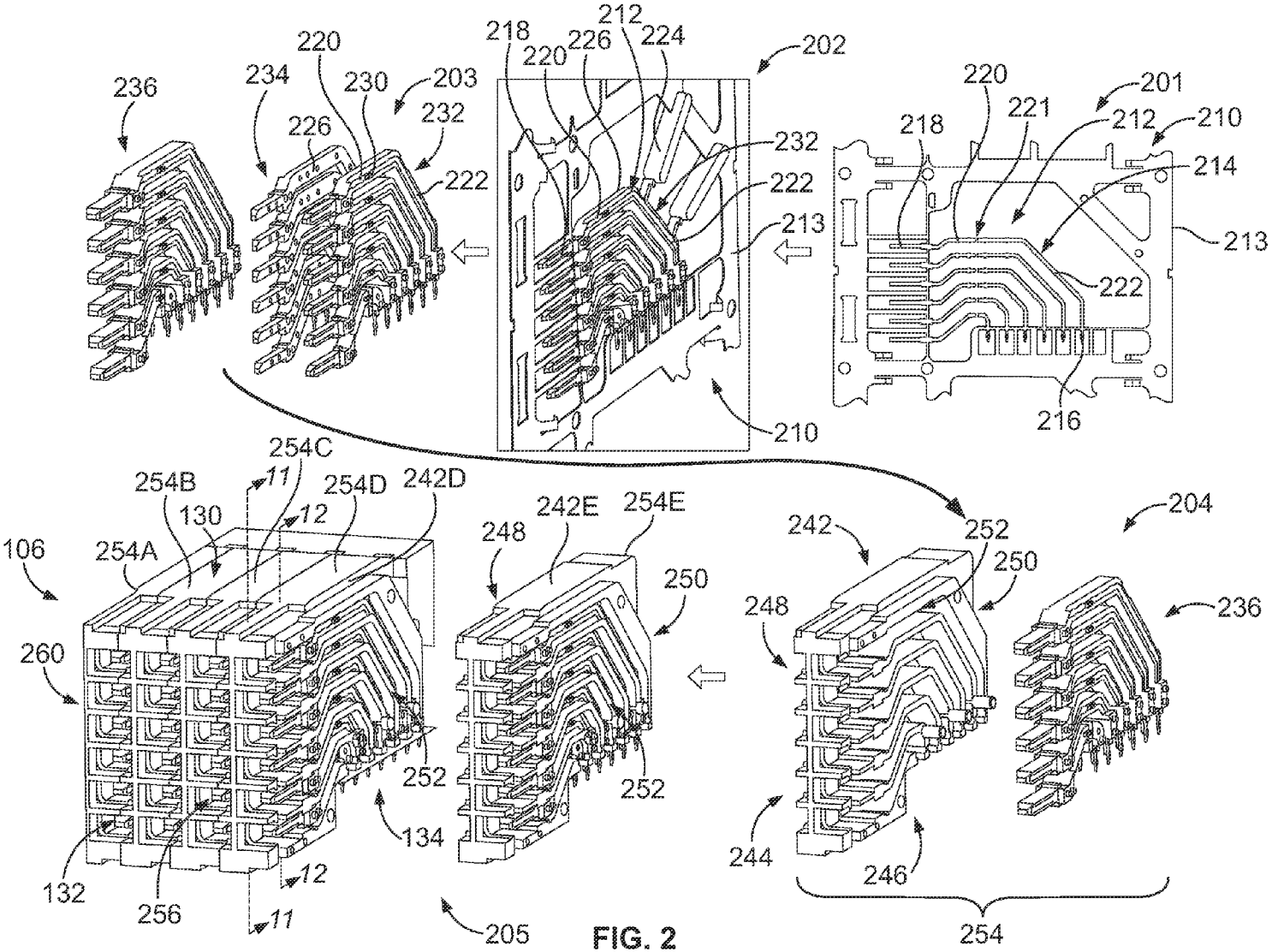
FIG. 2 illustrates a number of stages during assembly of the receptacle connector of FIG. 1 in accordance with one embodiment.

FIG. 2 illustrates multiple stages for the manufacture of the receptacle connector 106 in accordance with one embodiment. Although several stages are illustrated, it is understood that some stages may not be shown and that some embodiments may include fewer or more stages of manufacture. At stage 201, a leadframe 210 may be formed by stamping and/or etching the leadframe 210 from sheet metal. The sheet metal may be copper, copper alloy, or another metal that is capable of transmitting electrical current. As shown, the leadframe 210 includes an array of signal conductors 212 that are held by a frame body 213. Each of the signal conductors 212 includes a main body 214, a mounting end 216, and a mating end 218. In FIG. 2, the leadframe 210 includes six (6) signal conductors 212 that have different lengths.

At least some of the signal conductors 212 of the leadframe 210 may be disjointed signal conductors 212 that include a plurality of separate conductor segments. For example, in FIG. 2, each of the signal conductors 212 has first and second conductor segments 220, 222 that are separated by a signal gap 221. In the illustrated embodiment, only a single signal gap 221 exists within each of the signal conductors 212. In other embodiments, however, more than one signal gap may be formed such that three or more conductor segments are created. Furthermore, in other embodiments, at least one of the signal conductors 212 does not include a signal gap 221 and, instead, extends continuously between the mating and mounting ends 216, 218. The signal gap 221 may be formed, for example, when the leadframe 210 is stamped from sheet metal. Alternatively, the signal gap 221 may be formed by etching the leadframe 210 after the leadframe 210 is stamped from the sheet metal.

In the illustrated embodiment, signal conductors 212 are shaped for a right-angle electrical connector, such as the receptacle connector 106. In other embodiments, however, the signal conductors 212 may be shaped for a vertical connector. In such configurations, the signal conductors 212 may extend in a generally linear manner across the leadframe 210.

At stage 202, the leadframe 210 may be overmolded with a dielectric base 224 such that the signal conductors 212 are at least partially encased in the dielectric base 224. As shown in FIG. 2, the dielectric base 224 is molded over the conductor segments 220, 222 and the mating ends 218. After the dielectric base 224 is formed, at least portions of the conductor segments 220, 222 and the mating ends 218 may remain exposed. For instance, the leadframe 210 may be positioned within a shaping mold (not shown) and the dielectric base 224 (in liquid form) may be injected into the shaping mold. Outer surfaces of the conductor segments 220, 222 and the mating ends 218 may directly engage (e.g., press against) an interior surface of the shaping mold so that the exposed surfaces exist after the dielectric base cures or sets. In alternative embodiments, the dielectric base 224 may completely surround the conductor segments 220, 222 such that the conductor segments 220, 222 are not exposed to the surrounding environment. Subsequently, the dielectric base 224 may be removed (e.g., shave or etched) thereby exposing surfaces of the conductor segments 220, 222.

As shown in FIG. 2, the dielectric base 224 may form individual dielectric bodies or ribs 226. Each of the dielectric bodies 226 may be molded about (e.g., at least partially around) a single signal conductor 212 to form a pathway assembly 232. After stage 202, the dielectric bodies 226 and the signal conductors 212 may be singulated from the frame body 213. More specifically, portions of the dielectric bodies 226 and the signal conductors 212 may be separated (e.g., by etching) from the frame body 213 so that six (6) separate pathway assemblies 232 are formed. Before or after the singulation process, a plurality of signal-control components 230 (show at stage 203) may be directly attached to the signal conductors 212. As described in greater detail below, each of the signal-control components 230 may mechanically and electrically engage the first conductor segment 220 and mechanically and electrically engage the second conductor segment 222 thereby electrically coupling the conductor segments 220, 222.

At stage 203, the pathway assemblies 232 may be mated with corresponding pathway assemblies 234 to form transmission assemblies 236. The pathway assemblies 234 may be formed in a similar manner as the pathway assemblies 232. For example, each of the pathway assemblies 234 may include the dielectric body 226 and a signal conductor 240 (shown in FIG. 11) that is at least partially encased by the dielectric body 226. However, the pathway assemblies 232, 234 may be shaped differently so that the signal conductors 240 of the pathway assemblies 234 are exposed and face in an opposite direction than the exposed portions of the signal conductors 212 when the transmission assembly 236 is formed. More specifically, each of the transmission assemblies 236 includes a pair of signal conductors (i.e., the signal conductors 212 and 240) that face in opposite directions.

Although the above description references the transmission assembly as having two pathway assemblies, the transmission assembly may have only one pathway assembly. Alternatively, the pathway assembly may be shaped to have two signal conductors. The terms "transmission assembly" and "pathway assembly" have only been used to distinguish the components with respect to the illustrated embodiment. However, in some cases, the terms may be used interchangeably. For example, each of a transmission assembly and a pathway assembly may include one or more dielectric bodies and/or one or more signal conductors. As such, the use of the term "pathway assembly" in the claims should not be as interpreted as requiring only one dielectric body or only one signal conductor unless specifically claimed as such. Likewise, the use of the term "transmission assembly" in the claims should not be as interpreted as requiring two dielectric bodies that each surrounds a different signal conductor. Instead, a transmission assembly may include a single dielectric body with only one signal conductor or, for example, two signal conductors on opposite sides of the transmission assembly.

At stage 204, the transmission assemblies 236 may be positioned within a module body 242. For example, the module body 242 includes a mating edge 244, a mounting edge 246, and opposite module sides 248, 250. In the illustrated embodiment, the module side 250 includes a plurality of open-sided channels 252. Each of the open-sided channels 252 is dimensioned to receive one of the transmission assemblies 236. Collectively, the module body 242 and the transmission assemblies 236 that are disposed in the corresponding open-sided channels 252 may be referred to as a module assembly 254, which is shown in stage 205.

At stage 205, a plurality of the module assemblies 254 may be stacked side-by-side to form the receptacle connector 106. More specifically, a module assembly 254A may be sized and shaped to interface with the module assembly 254B. The module assembly 254A may have a different configuration than the module assemblies 254B-254E. For example, the module side 248 of the module assembly 254A becomes a connector side 260 of the receptacle connector 106 in the illustrated embodiment. After the module assembly 254A is coupled to the module assembly 254B, additional module assemblies 254C, 254D, and 254E may be stacked side-by-side with respect to one another to form the receptacle connector 106. After the modules assemblies 254A-254E are coupled to one another, a connector shield (not shown) may be attached to the module side 250 of the module assembly 254E.

Collectively, the module bodies 242 of the module assemblies 254A-254E form the connector body 130. The mating edges 244 collectively form the mating face 132, and the mounting edges 246 collectively form the mounting face 134. As assembled, the receptacle connector 106 includes a plurality of signal channels 256. In the illustrated embodiment, the signal channels 256 are partially defined by the open-sided channels 252 of one module body 242 and partially defined by the module side 248 of an adjacent module body 242. By way of example, at stage 205, the module assembly 254D has the module body 242D and the module assembly 254E has the module body 242E. The module body 242D may include the open-sided channels 252 and the module body 242E may include the module side 248 that encloses and defines the signal channels 256. In alternative embodiments, however, the signal channels 256 are not formed when the module bodies 242 are stacked side-by-side. Instead, a single module body 242 may be shaped to entirely define the signal channel 256.

Figure 3:
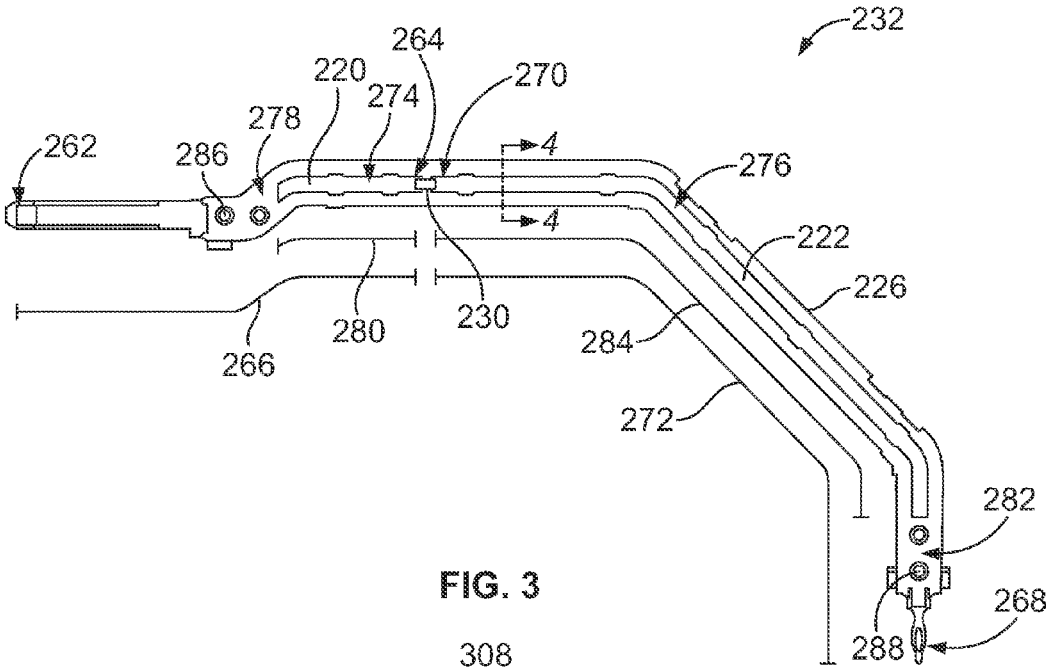
FIG. 3 is a plan view of a pathway assembly of the receptacle connector of FIG. 1 in accordance with one embodiment.

FIG. 3 is a plan view of one of the pathway assemblies 232. As shown, the pathway assembly 232 includes the conductor segments 220, 222, the dielectric body 226, and the signal-control component 230. The conductor segment 220 includes a mating end 262 and an interior end 264 and extends therebetween for a segment length 266, which is represented by a trace in FIG. 3 that has similar dimensions as the conductor segment 220. The conductor segment 222 includes a mounting end 268, an interior end 270 and extends therebetween for a segment length 272, which is also represented by a trace having similar dimensions as the conductor segment 222. The segment lengths 266, 272 are measured along a centerline of the conductor segments 220, 222, respectively. In some cases, the mating and mounting ends 262, 268 may be referred to generally as segment ends 262, 268.

The dielectric body 226 is partially molded about the conductor segments 220, 222. For example, the dielectric material of the dielectric body 226 may intimately engage multiple surfaces of the conductor segments 220, 222 such that the dielectric body 226 partially encases or envelopes the conductor segments 220, 222. However, the dielectric body 226 is only partially molded about the conductor segments 220, 222 such that each of the conductor segments 220, 222 includes exposed surfaces 274, 276, respectively. In particular embodiments, the exposed surfaces 274, 276 are configured to interface with air when the receptacle connector 106 (FIG. 1) is fully assembled. The exposed surface 274 extends longitudinally along the conductor segment 220 from the interior end 264 to a base portion 278 for an exposed length 280, which is represented by a trace with similar dimensions. The exposed surface 276 extends longitudinally along the conductor segment 222 from the interior end 270 to a base portion 282 for an exposed length 284, which is also represented by a trace with similar dimensions.

The base portions 278, 282 are portions of the dielectric body 226 that cover the exposed surfaces 274, 276, respectively. The base portions 278, 282 may completely surround the signal conductor 212. In the illustrated embodiment, the base portions 278, 282 are located proximate to the mating and mounting ends (or segment ends) 262, 268, respectively, and include respective attachment features 286, 288. The attachment features 286, 288 may engage other features of the receptacle connector 106 when the module assemblies 254 (FIG. 2) are stacked side-by-side. The attachment features 286, 288 in FIG. 3 are projections, which may be posts, latches, and the like. In other embodiments, the attachment features 286, 288 may have a different configuration. For instance, the attachment features 286, 288 may be cavities configured to receive such projections. In alternative embodiments, the pathway assembly 232 may include additional base portions or the base portions 278, 282 may have different locations. For example, a base portion may be located closer to a center of the pathway assembly 232.

In particular embodiments, the exposed lengths 280, 284 are configured, among other factors, to achieve a target electrical performance for the pathway assembly 232 or the receptacle connector 106 as a whole. More specifically, the exposed lengths 280, 284 may be configured to achieve a target impedance for the pathway assembly 232 or the receptacle connector 106 as a whole. By way of example, the exposed length 280 may be at least about 10% of the segment length 266. In particular embodiments, the exposed length 280 may be at least about 20% of the segment length 266 or, more particularly, at least about 33%. With respect to the exposed length 284, the exposed length 284 may be at least about 10% of the segment length 272. However, the exposed length 284 may be a greater percentage of the segment length 272. For example, the exposed length may be at least about 20%, at least about 40%, at least about 50%, at least about 65%, or at least about 75% of the segment length 272.

The above description may apply similarly to signal conductors that are not disjointed (i.e., that do not have separate conductor segments). In such embodiments, an exposed surface may have an exposed length that is a substantial percentage of a path length for the signal conductor that extends from the mating end to the mounting end and includes the mating end and the mounting end. For example, the exposed length may be at least about 30%, at least about 50%, at least about 60%, at least about 75%, or at least about 85% of a path length. The exposed length may extend for the entire path length, but for one or more areas of the signal conductor that are covered by a base portion.

Figure 4:
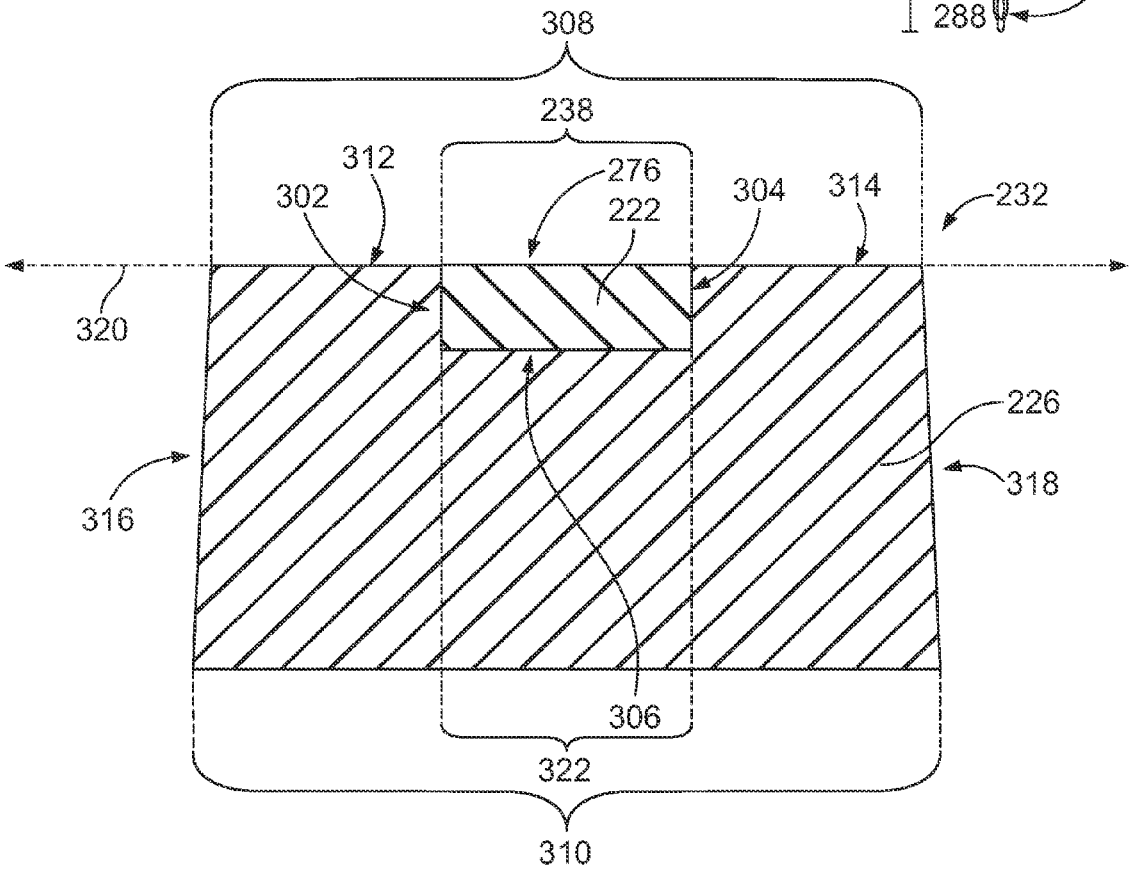
FIG. 4 is a cross-section of the pathway assembly taken along the line 4-4 in FIG. 3.

FIG. 4 is a cross-section of the pathway assembly 232 taken along the line 4-4 in FIG. 3. Although the cross-section specifically illustrates the dielectric body 226 and the conductor segment 222 at a particular location along the pathway assembly 232, the following description may be applicable to other locations of the signal conductor 212 (FIG. 2) and for signal conductors that do not have separate conductor segments. As such, the term "conductor segment" may be replaced with "signal conductor" in the following description of FIG. 3. The conductor segment 222 may be stamped or etched from sheet metal such that the conductor segment 222 has a substantially rectangular cross-sectional shape. As shown, the conductor segment 222 includes opposite edge surfaces 302, 304, a covered surface 306, and the exposed surface 276. The covered and exposed surfaces 306, 276 face in opposite directions. Each of the edge surfaces 302, 304 extends between the covered surface 306 and the exposed surface 276.

The dielectric body 226 is configured to hold the signal conductor 212. In the illustrated embodiment, the dielectric body 226 forms an open channel 238 when the dielectric body 226 is molded to the conductor segment 222. The open channel 238 has the conductor segment 222 disposed therein. In some embodiments, the open channel 238 may be formed after a dielectric medium in a liquid state cures or sets around the conductor segment 222 so that the dielectric medium is in solid state. The dielectric body 226 is molded over the edge surfaces 302, 304 and the covered surface 306 such that the dielectric body 226 intimately engages the edge surfaces 302, 304 and the covered surface 306. In other embodiments, the open channel 238 may be separately formed with the dielectric body 226 and the conductor segment 222 may be inserted thereafter such that the dielectric body 226 holds the conductor segment 222.

Also shown, the pathway assembly 232 has an outer face 308 and an inner face 310 that face in opposite directions. In FIG. 4, the exposed surface 276 extends down a center of the outer face 308 such that the exposed surface 276 divides the outer face 308. The exposed surface 276 separates material surfaces 312, 314, which are exterior surfaces of the dielectric body 226. The exposed surface 276 and the material surfaces 312, 314 collectively form the outer face 308. The pathway assembly 232 also has opposite body sides 316, 318 that extend between the outer and inner faces 308, 310. As shown, a cross-sectional shape of the pathway assembly 232 may be approximately rectangular. For example, the body sides 316, 318 may slightly incline or slope toward each other as the body sides 316, 318 extend from the inner face 310 toward the outer face 308.

As described herein, the exposed surface 276 may not be overmolded by the dielectric body 226. For example, the exposed surface 276 may define a surface plane 320. The material surfaces 312, 314 of the dielectric body 226 may not clear the surface plane 320. In particular embodiments, the material surfaces 312, 314 coincide with the surface plane 320 such that exposed surface 276 and the material surfaces 312, 314 are substantially level. As such, the outer face 308 may be substantially planar. In other embodiments, the dielectric material may clear the surface plane 320 but not cover the exposed surface 276.

In the illustrated embodiment, the conductor segment 222 has a cross-sectional width 322 defined between the edge surfaces 302, 304. The exposed surface 276 of the conductor segment 222 may extend laterally across the entire width 322. In other embodiments, however, the dielectric material of the dielectric body 226 may clear the surface plane 320 and partially cover the conductor segment 222, but a portion may remain as the exposed surface 276. In some embodiments, the exposed length 284 (FIG. 3) is at least five times the cross-sectional width 322.

Figure 5:
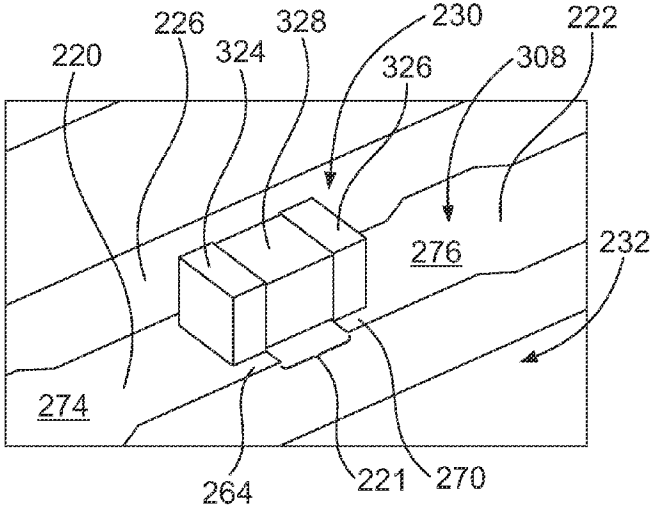
FIG. 5 is an enlarged perspective view of a pathway assembly including a signal-control component in accordance with one embodiment.
Figure 6:
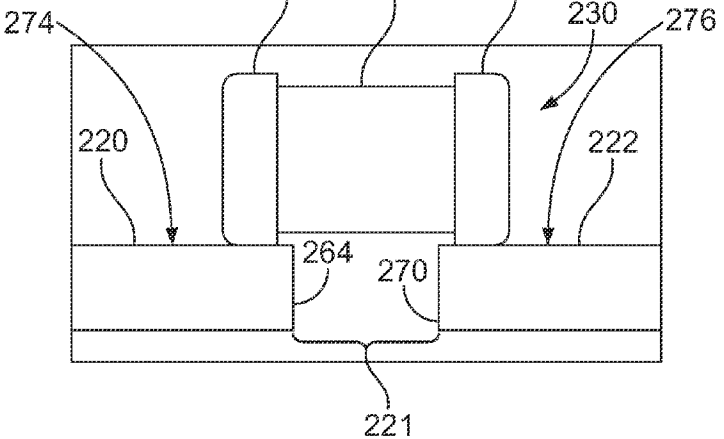
FIG. 6 is an isolated side view of the signal-control component mounted to conductor segments.

FIG. 5 is an enlarged perspective view of the signal-control component 230 mounted to the outer face 308 of the pathway assembly 232 or, more specifically, mounted to the conductor segments 220, 222. FIG. 6 is a side view of signal-control component 230 mounted to the conductor segments 220, 222 with the dielectric body 226 (FIG. 5) removed. With respect to FIGS. 5 and 6, the signal-control component 230 includes component ends 324, 326 and a component body 328 that extends between the component ends 324, 326. In the illustrated embodiment, the signal-control component 230 is a capacitor, such as a multilayer ceramic chip capacitor. In other embodiments, however, the signal-control component 230 may be an inductor, resistor, or other circuitry that is capable of modifying current that flows through the conductor segments 220, 222. Moreover, the signal-control component 230 is a passive component in FIGS. 5 and 6, but may be an active component in other embodiments.

When the signal-control component 230 is a capacitor, the component body 328 may include multiple dielectric and electrode layers having a serial structure, and the component ends 324, 326 may be external electrodes comprising a conductive material, such as tin and/or copper. The component ends 324, 326 may be mechanically and electrically joined to the interior ends 264, 270. For example, the component ends 324, 326 may be soldered, welded (e.g., ultrasonic welding), and/or adhered to the component ends 324, 326 using, for example, a conductive paste.

In FIGS. 5 and 6, the signal-control component 230 extends directly across the signal gap 221 to join the conductor segments 220, 222. More specifically, the signal control component 230 is directly attached to the interior end 264 and directly attached to the interior end 270 as shown. In other embodiments, the signal-control component 230 may be indirectly coupled to the conductor segments.

Notably, due to the exposed surfaces 274, 276, the conductor segments 220, 222 provide a clear and open space for positioning the signal-control component 230 and joining the component ends 324, 326 to the interior ends 264, 270, respectively. Moreover, the exposed surfaces 274, 276 enable a visual inspection of the pathway assembly 232 (FIG. 5) that may be easier than other known electrical connectors.

Figure 7:
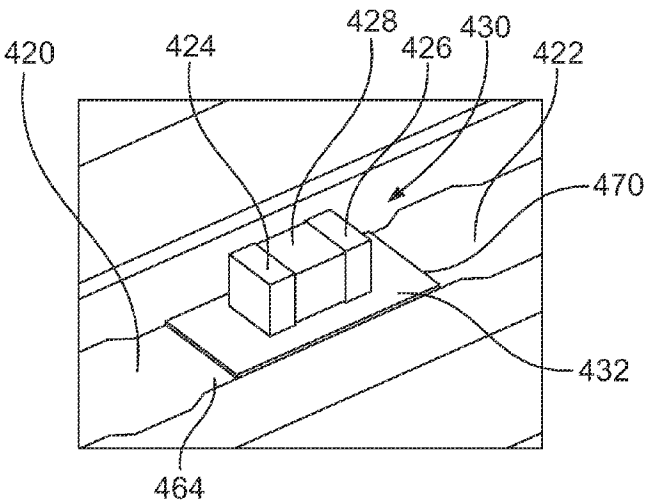
FIG. 7 is an enlarged perspective view of a pathway assembly including a signal-control component mounted to a printed circuit in accordance with one embodiment.
Figure 8:
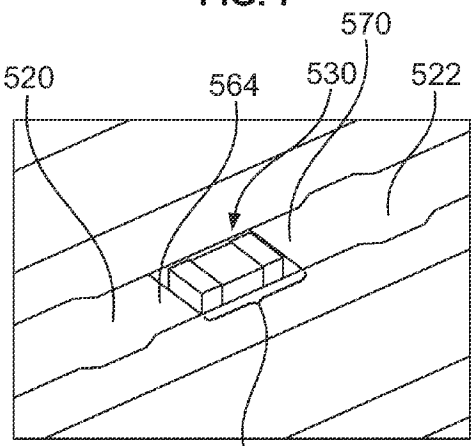
FIG. 8 is an enlarged perspective view of a pathway assembly including a signal-control component that is disposed within a signal gap between two conductor segments.

FIGS. 7 and 8 illustrate additional methods of mechanically and electrically joining conductor segments using a signal-control component. For example, in FIG. 7, a signal-control component 430 is shown that may be similar or identical to the signal-control component 230. The signal-control component 430 has components ends 424, 426 and a component body 428. Also shown, the signal-control component 430 may be mounted to a printed circuit 432 that, in turn, is mounted to interior ends 464, 470 of conductor segments 420, 422. In particular embodiments, the printed circuit 432 is a flexible printed circuit (or "flex circuit") that is capable of bending or folding. In such embodiments that use a flex circuit, the flex circuit may permit movement of the conductor segments 420, 422 relative to each other and/or sustain vibrations during operation better than more direct mounting techniques.

FIG. 8 illustrates a signal-control component 530 disposed directly within a signal gap 521 between interior ends 564, 570 of conductor segments 520, 522. The signal-control component 530 may be mechanically and electrically joined to the conductor segments 520, 522 in a similar manner as described above. For example, the signal-control component 530 may be soldered, welded, and or pasted to the interior ends 564, 570.

Figure 10:
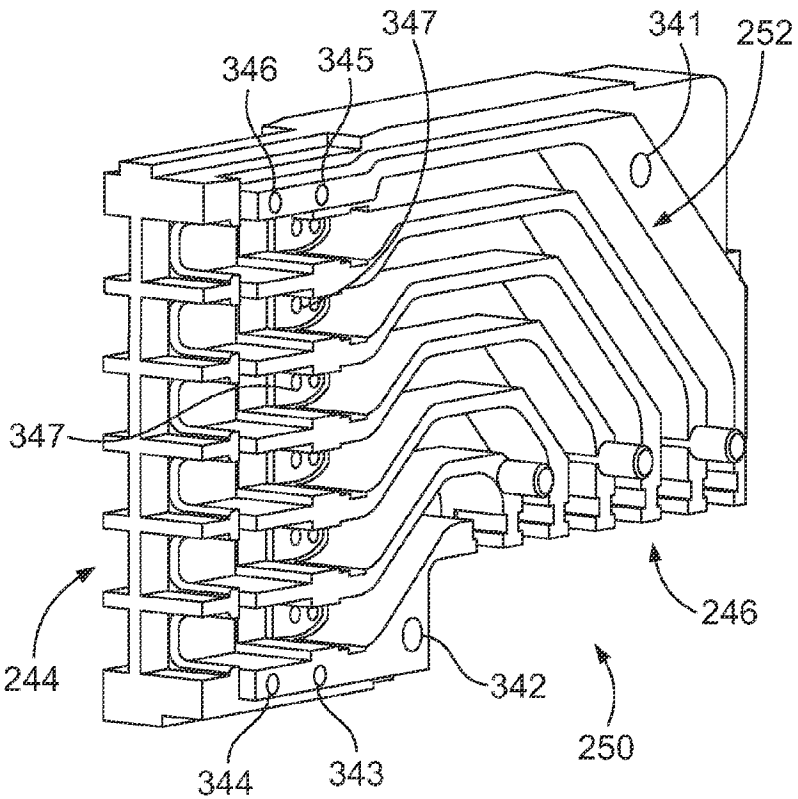
FIG. 10 is another perspective view of the module body of FIG. 9.
Figure 9:
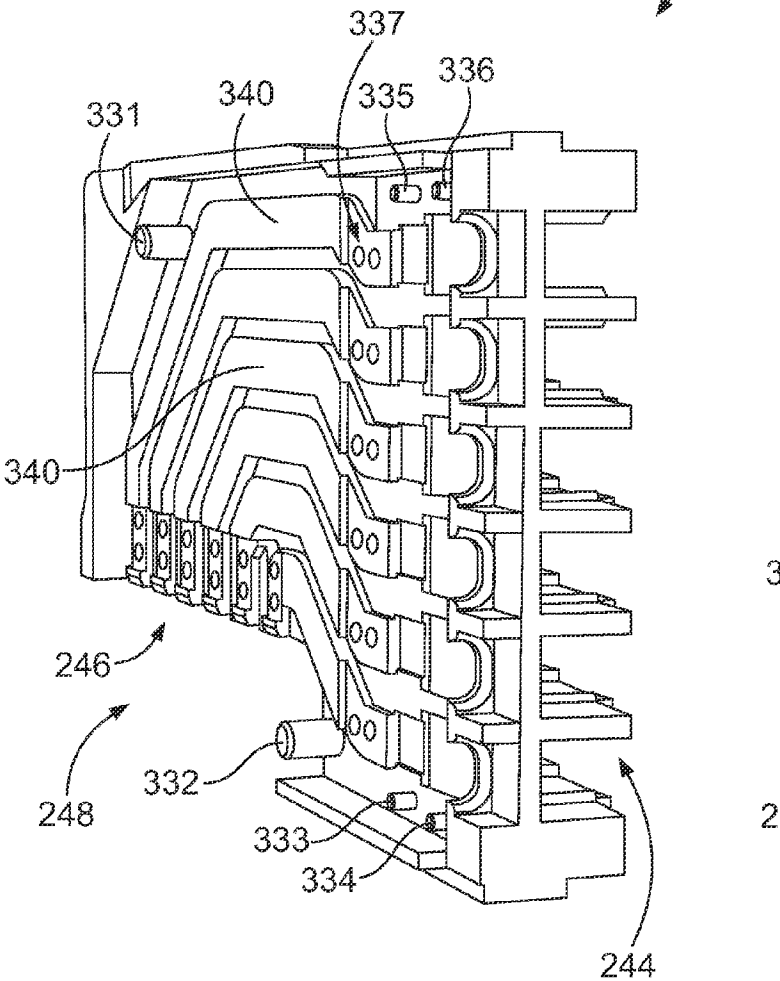
FIG. 9 is a perspective view of a module body formed in accordance with one embodiment.

FIGS. 9 and 10 are perspective views of one example of the module body 242. In particular, FIG. 9 shows the module side 248 in greater detail, and FIG. 10 shows the module side 250 in greater detail. As described above, the module bodies 242 of the module assemblies 254B-254E (FIG. 2) may be stacked side-by-side when the receptacle connector 106 (FIG. 1) is fully assembled. More specifically, the module side 248 of one module assembly 254 (FIG. 2) may be coupled to the module side 250 of an adjacent module assembly 254.

As shown in FIG. 9, the module side 248 includes module-connecting features 331-336 and pathway-connecting features 337. In the illustrated embodiment, the module-connecting features 331-336 are projections or posts, and the pathway-connecting features 337 are cavities. In alternative embodiments, the module-connecting features 331-336 may be cavities or a combination of projections and cavities, and the pathway-connecting features 337 may be projections or a combination of cavities and projections. Also shown in FIG. 9, the module side 248 includes a plurality of elongated pathway platforms 340. The pathway platforms 340 extend generally between the mating edge 244 and the mounting edge 246 of the module body 242.

With respect to FIG. 10, the module side 250 includes module-connecting features 341-346 and pathway-connecting features 347. In the illustrated embodiment, the module-connecting features 341-346 are cavities which are configured to receive the posts 331-336 (FIG. 9), and the pathway-connecting features 347 are cavities which are configured to engage attachment features of the transmission assembly 236 (FIG. 2). In alternative embodiments, the module-connecting features 341-346 may be projections or a combination of cavities and projections, and the pathway-connecting features 347 may be projections or a combination of cavities and projections. Also shown in FIG. 10, the open-sided channels 252 extend from the mating edge 244 to the mounting edge 246 of the module body 242.

As described above, prior to the module bodies 242 of two module assemblies 254 (FIG. 2) being stacked side-by-side, the transmission assemblies 236 (FIG. 2) may be disposed in corresponding open-sided channels 252 of one of the module assemblies 254. By way of example, attachment features (e.g., similar to the attachment features 286 shown in FIG. 3) of the transmission assembly 236 (shown in FIG. 2) may engage the pathway-connecting features 347 to secure the transmission assemblies 236 within the corresponding open-sided channels 252. When the module bodies 242 are stacked together, the module-connecting features 331-336 and 341-346 engage each other, respectively, and form frictional engagements. At the same time, the attachment features 286 of the transmission assembly 236 may engage the pathway-connecting features 337 along the module side 248 to secure the module bodies 242 together. As described in greater detail below, when the module bodies 242 are stacked together, the pathway platforms 340 are positioned at least partially within corresponding open-sided channels 252.

Figure 11:
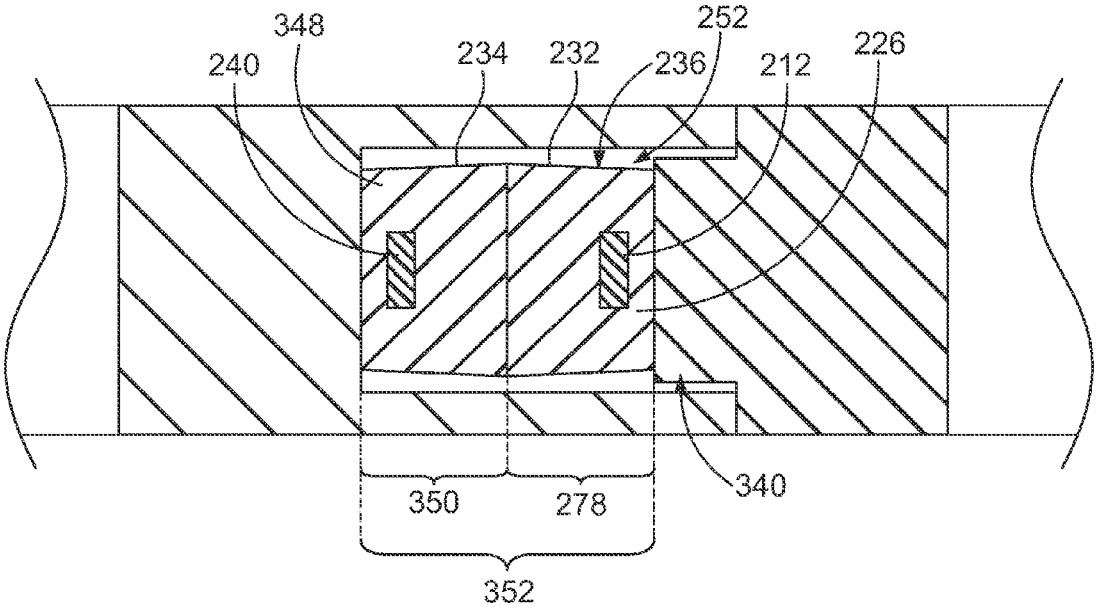
FIG. 11 is a cross-section of a transmission assembly of the fully constructed receptacle connector in accordance with one embodiment.

FIG. 11 is a cross-section of one of the transmission assemblies 236 within the corresponding open-sided channel 252. As described above, the transmission assembly 236 includes the pathway assemblies 232, 234 mated or stacked side-by-side. The pathway assembly 234 includes a dielectric body 348 having a base portion 350, which may be similar to the base portion 278 of the dielectric body 226. When the pathway assemblies 232, 234 are stacked together, a transmission base 352 may be formed when the base portions 278, 350 are combined as shown in FIG. 11.

Also shown, the signal conductor 212 extends through the base portion 278 of the dielectric body 226, and the signal conductor 240 extends through the base portion 350. The pathway platform 340 is disposed partially within the open-sided channel 252 and interfaces with the base portion 278. Notably, neither of the signal conductors 212, 240 is exposed to air in FIG. 11.

Figure 12:
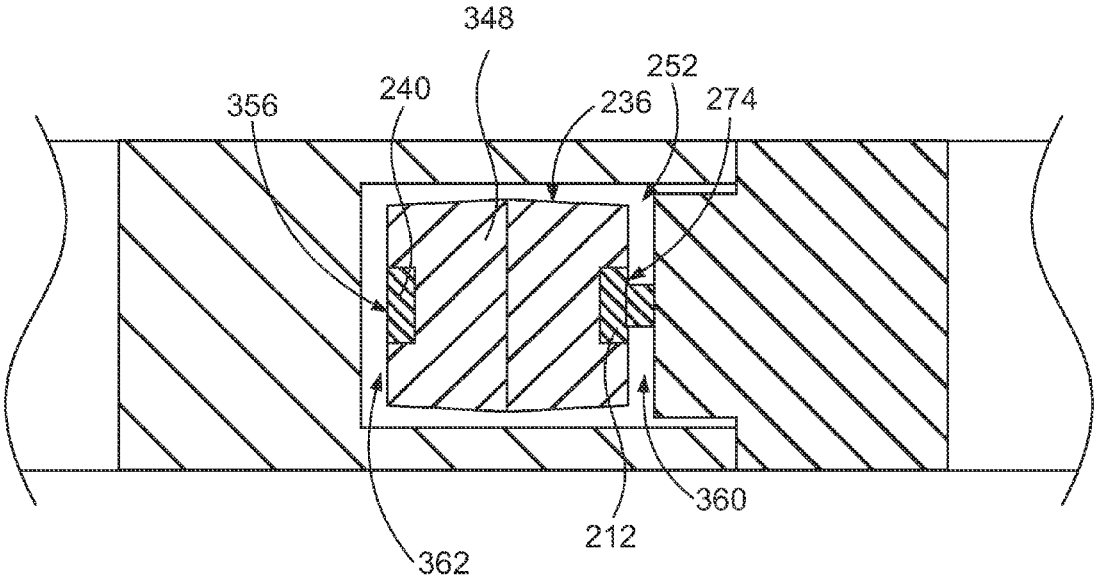
FIG. 12 is another cross-section of the transmission assembly of FIG. 11.

FIG. 12 is a cross-section of the transmission assembly 236 in FIG. 11. In some embodiments, the transmission assembly 236 may include a pair of signal conductors that are both exposed to air within the open-sided channel 252. For example, the exposed surface 274 of the signal conductor 212 is shown in FIG. 12 and is exposed to an air gap 360 (or air dielectric). The air gap 360 may have a predetermined size and shape relative to other factors to achieve a target electrical performance. The signal conductor 240 also includes an exposed surface 356. Unlike the exposed surface 274, which is interrupted by the signal gap 221 (FIG. 2), the exposed surface 356 may extend continuously along the dielectric body 348. The exposed surface 356 is also exposed to an air gap 362 (or air dielectric), which may have a predetermined size and shape relative to other factors to achieve a target electrical performance As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector body having a mating face configured to engage a mating connector and a mounting face configured to engage an electrical component; and a pathway assembly extending between the mating and mounting faces within the connector body, the pathway assembly including a signal conductor having separate conductor segments and a dielectric body that holds the conductor segments, the conductor segments having respective interior ends that are positioned adjacent to each other with a signal gap therebetween, wherein one of the conductor segments forms a mating end of the signal conductor that is configured to engage the mating connector, the pathway assembly also including a signal-control component that electrically joins the conductor segments and is configured to modify current flowing through the conductor segments;

wherein the dielectric body forms an open channel having at least one of the conductor segments disposed therein, the at least one conductor segment having an exposed surface that interfaces with an air gap in the connector body.

2. The electrical connector of claim 1, wherein the pathway assembly has an outer face that includes the exposed surface and material surfaces of the dielectric body, the exposed surface coinciding with a surface plane, wherein the material surfaces do not clear the surface plane.

3. The electrical connector of claim 1, wherein the at least one conductor segment has a segment length, the exposed surface having an exposed length that is at least 20% of the segment length.

4. The electrical connector of claim 1, further comprising a module body having an open-sided channel, the open-sided channel being sized and shaped to receive the pathway assembly therein.

5. The electrical connector of claim 4, wherein the module body and the pathway assembly collectively form a module assembly, the module assembly being a first module assembly and the electrical connector also including a second module assembly, the first and second module assemblies being stacked side-by-side.

6. The electrical connector of claim 1, wherein the signal-control component is one of a capacitor, inductor, or resistor and the electrical connector is a high-speed connector configured to transmit data signals at greater than 20 Gbps.

7. The electrical connector of claim 1, wherein the signal conductor is a first signal conductor and the pathway assembly includes a second signal conductor that extends through the dielectric body parallel to the first signal conductor, the first and second signal conductors having an essentially common length.

8. The electrical connector of claim 1, wherein the conductor segments are co-planar.

9. An electrical connector comprising:

a connector body having a mating face and a mounting face that are configured to engage respective electrical components; and a pathway assembly extending between the mating and mounting faces within the connector body, the pathway assembly including a signal conductor having separate conductor segments and a dielectric body that holds the conductor segments, the conductor segments having respective interior ends that are positioned adjacent to each other with a signal gap therebetween, the pathway assembly also including a signal-control component that electrically joins the conductor segments and is configured to modify current flowing through the conductor segments;

wherein the dielectric body forms an open channel having at least one of the conductor segments disposed therein, the at least one conductor segment having an exposed surface that interfaces with an air gap in the connector body;

wherein the pathway assembly is a first pathway assembly, the electrical connector further comprising a second pathway assembly that includes a signal conductor and a dielectric body that holds the signal conductor of the second pathway assembly, wherein the dielectric bodies of the first and second pathway assemblies are mated side-by-side.

10. The electrical connector of claim 9, wherein the second pathway assembly is devoid of a signal-control component.

11. The electrical connector of claim 9, wherein the first and second pathway assemblies form a transmission assembly when mated side-by-side, the electrical connector further comprising a plurality of transmission assemblies and a module body, the plurality of transmission assemblies being held by the module body, each of the transmission assemblies being held within a separate signal channel of the electrical connector that is partially formed by the module body.

12. The electrical connector of claim 11, wherein the second signal conductor includes an exposed surface, the exposed surfaces of the first and second signal conductors extending along opposite outer faces of the dielectric body and facing in opposite directions.

13. An electrical connector comprising:

first and second module bodies stacked side-by-side, the first and second module bodies collectively forming a mating face and a mounting face of the electrical connector, the first module body having a module side that forms open-sided channels that extend between the mating and mounting faces, the second module body enclosing the open-sided channels of the first module body when stacked side-by-side to define separate signal channels that extend between the mating and mounting faces; and pathway assemblies extending through the signal channels between the mating and mounting faces, each of the pathway assemblies including a signal conductor and a dielectric body that holds the signal conductor such that the signal conductor has an exposed surface, the exposed surface facing one of the first or second module bodies in the signal channel with a predetermined air gap therebetween.

14. The electrical connector of claim 13, wherein the pathway assembly has an outer face that includes the exposed surface and material surfaces of the dielectric body, the exposed surface coinciding with a surface plane, wherein the material surfaces do not clear the surface plane.

15. The electrical connector of claim 13, wherein the signal conductor is a disjointed signal conductor having separate conductor segments, the pathway assembly including a signal-control component that electrically joins the conductor segments of the signal conductor, the signal-control component configured to modify current flowing through the conductor segments.

16. The electrical connector of claim 15, wherein the signal-control component is one of a capacitor, inductor, or resistor.

17. The electrical connector of claim 13, wherein the exposed surface extends continuously for greater than about 50% of a path length of the signal conductor between first and second base portions, each of the first and second base portions completely surrounding the signal conductor.

18. The electrical connector of claim 17, wherein at least one of the first or second base portions includes an attachment feature, the attachment feature configured to directly engage the second module body to secure the first and second module bodies together.

19. The electrical connector of claim 13, wherein the pathway assembly is a first pathway assembly, the electrical connector further comprising a second pathway assembly that includes a signal conductor and a dielectric body that holds about the signal conductor such that the signal conductor of the second pathway assembly has an exposed surface, wherein the first and second pathway assemblies are mated together such that the exposed surfaces of the first and second pathway assemblies face in opposite directions.

20. The electrical connector of claim 13, wherein the first module body forms a shared wall that separates adjacent open-sided channels along the module side, the shared wall engaging a module side of the second module body when the first and second module bodies are stacked side-by-side, the shared wall defining adjacent signal channels.

* * * * *